US009669421B2

(12) United States Patent
Miura et al.

(10) Patent No.: US 9,669,421 B2
(45) Date of Patent: Jun. 6, 2017

(54) GRAVURE KISS COATER

(71) Applicants: FUJI KIKAI KOGYO CO., LTD., Hiroshima (JP); TOYOTA JIDOSHA KABUSHIKI KAISHA, Toyota-shi, Aichi (JP)

(72) Inventors: Hidenobu Miura, Hiroshima (JP); Masakazu Umehara, Toyota (JP)

(73) Assignees: FUJI KIKAI KOGYO CO., LTD., Hiroshima (JP); TOYOTA JIDOSHA KABUSHIKI KAISHA, Aichi (JP)

( * ) Notice: Subject to any disclaimer, the term of this patent is extended or adjusted under 35 U.S.C. 154(b) by 183 days.

(21) Appl. No.: 14/389,449

(22) PCT Filed: Mar. 12, 2014

(86) PCT No.: PCT/JP2014/001407

§ 371 (c)(1),
(2) Date: Sep. 30, 2014

(87) PCT Pub. No.: WO2014/188640

PCT Pub. Date: Nov. 27, 2014

(65) Prior Publication Data

US 2016/0250658 A1 Sep. 1, 2016

(30) Foreign Application Priority Data

May 24, 2013 (JP) ..... 2013-109939

(51) Int. Cl.
*B05C 1/08* (2006.01)
*B41F 9/10* (2006.01)
(Continued)

(52) U.S. Cl.
CPC ..... *B05C 1/0813* (2013.01); *B05C 1/0826* (2013.01); *B41F 9/10* (2013.01);
(Continued)

(58) Field of Classification Search
CPC ... B05C 1/0813; B05C 1/0826; B05C 1/0808; B05C 1/0817; B05C 1/047; B05C 1/0839; B41F 31/027; B41F 9/10
(Continued)

(56) References Cited

U.S. PATENT DOCUMENTS 5,497,702 A * 3/1996 Gorter ..... B41F 31/027 101/366
6,277,196 B1 * 8/2001 Woodman ..... B05C 1/0808 118/211

FOREIGN PATENT DOCUMENTS

CN 201390011 Y 1/2010
CN 101844121 A 9/2010
(Continued)

OTHER PUBLICATIONS

International Search Report and Written Opinion for corresponding International Application No. PCT/JP2014/001407, dated Jun. 17, 2014.

*Primary Examiner* — Laura Edwards
(74) *Attorney, Agent, or Firm* — Renner, Otto, Boisselle & Sklar, LLP

(57) ABSTRACT

A gravure kiss coater 1 includes a paint feeder 30 placed along a small-diameter gravure roll 10 having an outside diameter D in a range of 45-150 mm. The paint feeder 30 includes a doctor blade 32, a case 31, and a coating feed path 34, 35. A distal end 32*a* of the doctor blade 32 is directed in a direction opposite to a direction of rotation of the small-diameter gravure roll 10, and the small-diameter gravure roll 10 is capable of contacting the substrate S within a range of rotation angles equal to or less than 90° from the distal end 32*a* of the doctor blade 32.

2 Claims, 7 Drawing Sheets

(51) Int. Cl.
*B41F 31/02* (2006.01)
*B05C 11/04* (2006.01)

(52) U.S. Cl.
CPC ..... *B05C 1/0808* (2013.01); *B05C 1/0817* (2013.01); *B05C 1/0839* (2013.01); *B05C 11/047* (2013.01); *B41F 31/027* (2013.01)

(58) Field of Classification Search
USPC ..... 118/203, 211, 212, 261, 413, 304, 262; 101/366
See application file for complete search history.

(56) References Cited

FOREIGN PATENT DOCUMENTS

| | | | |
|---|---|---|---|
| DE | 41 38 807 | C1 | 6/1993 |
| JP | 64-44078 | U | 3/1989 |
| JP | 2-7663 | Y | 2/1990 |
| JP | 10-151391 | A | 6/1998 |
| JP | 2001-321707 | A | 11/2001 |
| JP | 2002-059052 | A | 2/2002 |
| JP | 2003-236429 | A | 8/2003 |
| JP | 2003-251241 | A | 9/2003 |
| JP | 2010-221204 | A | 10/2010 |
| JP | 2011-245448 | A | 12/2011 |
| WO | WO 2012-161779 | A1 | 11/2012 |

* cited by examiner

GRAVURE KISS COATER

TECHNICAL FIELD

The present disclosure relates to gravure kiss coaters, and more particularly to a gravure kiss coater including a small-diameter gravure roll among them.

BACKGROUND ART

A gravure kiss coater is an apparatus configured to coat a flat sheet-like substrate that travels while being stretched and floating by rotating and simultaneously pressing a gravure roll on which paint is deposited against the substrate.

Unlike a typical gravure coater, the gravure kiss coater coats the substrate without sandwiching the substrate between the gravure roll and an impression cylinder. For this reason, the gravure kiss coater can coat the substrate with thin paint by making a predetermined difference between the speed of travel of the substrate and the speed of rotation of the gravure roll, and is thus suitable for the application of a thin coating.

For example, PATENT DOCUMENTS 1 and 2 describe this type of coater including a gravure roll of small diameter.

Specifically, the gravure coater of PATENT DOCUMENT 1 includes a gravure roll having a diameter of about 20-50 mm. The coater of PATENT DOCUMENT 2 includes a gravure roll having an outside diameter of about 40-200 mm.

CITATION LIST

Patent Documents

PATENT DOCUMENT 1: Japanese Unexamined Patent Publication No. H10-151391

PATENT DOCUMENT 2: Japanese Unexamined Patent Publication No. 2010-221204

PATENT DOCUMENT 3: Japanese Examined Utility Model (Registration) Publication No. H02-7663

SUMMARY OF THE INVENTION

Technical Problem

After a substrate is coated, the coated substrate is usually dried to adhere paint to the substrate through a dryer. It requires a long time to dry the paint, and the space for the dryer must be, therefore, larger than the space for the gravure coater. If the speed of travel of the substrate is high, the space for the dryer must be much larger than the space for the gravure coater.

However, such a coating process may adversely affect the coating performance. Specifically, in the gravure kiss coater, thin paint deposited on the outer circumferential surface of the gravure roll is temporarily exposed to outside air before being applied onto the substrate. For this reason, before the substrate is coated with the paint, drying of the paint proceeds, and the substrate may be unstably coated.

In view of this problem, a coater being similar to the coaters of PATENT DOCUMENTS 1 and 2 and including a gravure roll of small diameter is advantageous. The reason for this is that since the outside diameter of the gravure roll is small, the period during which the paint is exposed to outside air is short.

However, in each of the coaters, a doctor blade is located apart from the location at which the substrate is coated to reduce the thickness of the paint deposited on the outer circumferential surface of the gravure roll. Thus, the coater cannot be said to be appropriate for addressing the problem.

A doctor blade disposed at such an angle (natural angle) as described in PATENT DOCUMENT 3 can easily press an area close to a substrate. Meanwhile, when the doctor blade is disposed at a natural angle, and a gravure roll rotates at high speed, the pressure of paint lifts the doctor blade, and paint is excessively fed to the substrate.

It is therefore an object of the present disclosure to provide a gravure kiss coater that can stably coat a substrate even with a paint tending to be easily dried without impairment of the coating performance, and is suitable for high-speed operation.

Solution to the Problem

A gravure kiss coater according to the present disclosure includes: a cylindrical small-diameter gravure roll having an outside diameter in a range of 45-150 mm, and having an outer circumferential surface including a coating portion; and a paint feeder extending along the small-diameter gravure roll and configured to feed paint to the coating portion. While rotation of the small-diameter gravure roll is controlled, a sheet-like substrate is coated with paint by pressing the coating portion against the substrate traveling while being stretched linearly.

The paint feeder includes a doctor blade extending along the small-diameter gravure roll and having a distal end contacting the coating portion moving toward a location at which the coating portion contacts the substrate, a case configured to support the doctor blade and forming a storage space configured to store paint, and a paint feed path through which paint is fed to the storage space. The distal end of the doctor blade is located so as to contact the coating portion from a reverse angle, that is, a direction opposite to a direction of rotation of the small-diameter gravure roll, and the small-diameter gravure roll is capable of contacting the substrate within a range of rotation angles equal to or less than 90° from the distal end of the doctor blade.

Specifically, according to the gravure kiss coater, the outside diameter of the small-diameter gravure roll is small, and the substrate can be coated with paint before the small-diameter gravure roll rotates 90° from the distal end of the doctor blade configured to reduce the thickness of paint on the coating portion. Thus, the substrate can be instantaneously coated even with a paint tending to be easily dried. This can effectively reduce the influence of the drying of paint before the coating on the coating performance.

In addition, since the distal end of the doctor blade is located so as to contact the coating portion from the direction opposite to the direction of rotation of the small-diameter gravure roll, redundant paint can be effectively scraped without allowing the liquid pressure to lift the doctor blade, and paint can be stably and accurately deposited on the substrate even during high-speed operation.

Furthermore, in the gravure kiss coater of the present disclosure, the case may support a seal blade extending along the small-diameter gravure roll and having a distal end contacting the coating portion moving away from the location at which the coating portion contacts the substrate. The storage space may be sealed such that the paint feeder is capable of being horizontally oriented to allow vertical arrangement of the doctor blade and the seal blade. If the paint feeder is horizontally oriented, at least any one of uppermost and lowermost ends of the paint feeder may be located between a pair of tangent lines being each tangent to a corresponding one of upper and lower ends of the small-diameter gravure roll when viewed along a rotation axis of the small-diameter gravure roll.

With this configuration, the above-mentioned placement of the doctor blade can be easily achieved. In addition, the substrate traveling in any one of various directions, such as a vertical direction or a horizontal direction, can be coated with the gravure kiss coater horizontally oriented, and excellent versatility can be thus achieved.

Moreover, in the gravure kiss coater of the present disclosure, the case may include a downstream wall portion being continuous with the doctor blade and defining the storage space, and an upstream wall portion facing the downstream wall portion, being continuous with the seal blade, and defining the storage space. The paint feed path may include a liquid feed pipe which has a connection port having one end close to the upstream wall portion, and through which paint is fed to the storage space, and at least one liquid return pipe which has a connection port having one end close to the downstream wall portion, and through which paint is returned from the storage space. An inside diameter of each of the liquid feed pipe and the at least one liquid return pipe may be set at a value greater than or equal to ½ of an interval between the downstream wall portion and the upstream wall portion.

With this configuration, while the turbulent flow of paint in the storage space is reduced, air introduced into the storage space can be effectively removed. Thus, even and accurate coating can be achieved.

More specifically, the at least one liquid return pipe may include two liquid return pipes, the two liquid return pipes may be placed at locations corresponding to both end portions of the small-diameter gravure roll, and the single liquid feed pipe may be placed midway between the two liquid return pipes.

This allows the flow of paint in the storage space to be smooth, and allows paint to be fed to the entire area of the coating portion so as to be dispersed over the entire area. Thus, more stable coating can be achieved.

Advantages of the Invention

According to the gravure kiss coater of the present disclosure, the substrate can be stably coated even with a paint tending to be easily dried without impairment of the coating performance. This renders a coating line more compact, and improves production efficiency.

DESCRIPTION OF EMBODIMENTS

Embodiments of the present disclosure will be described below in detail with reference to the drawings. The following embodiments are merely examples in nature, and are not intended to limit the scope, applications, and use of the invention.

Figure 1:
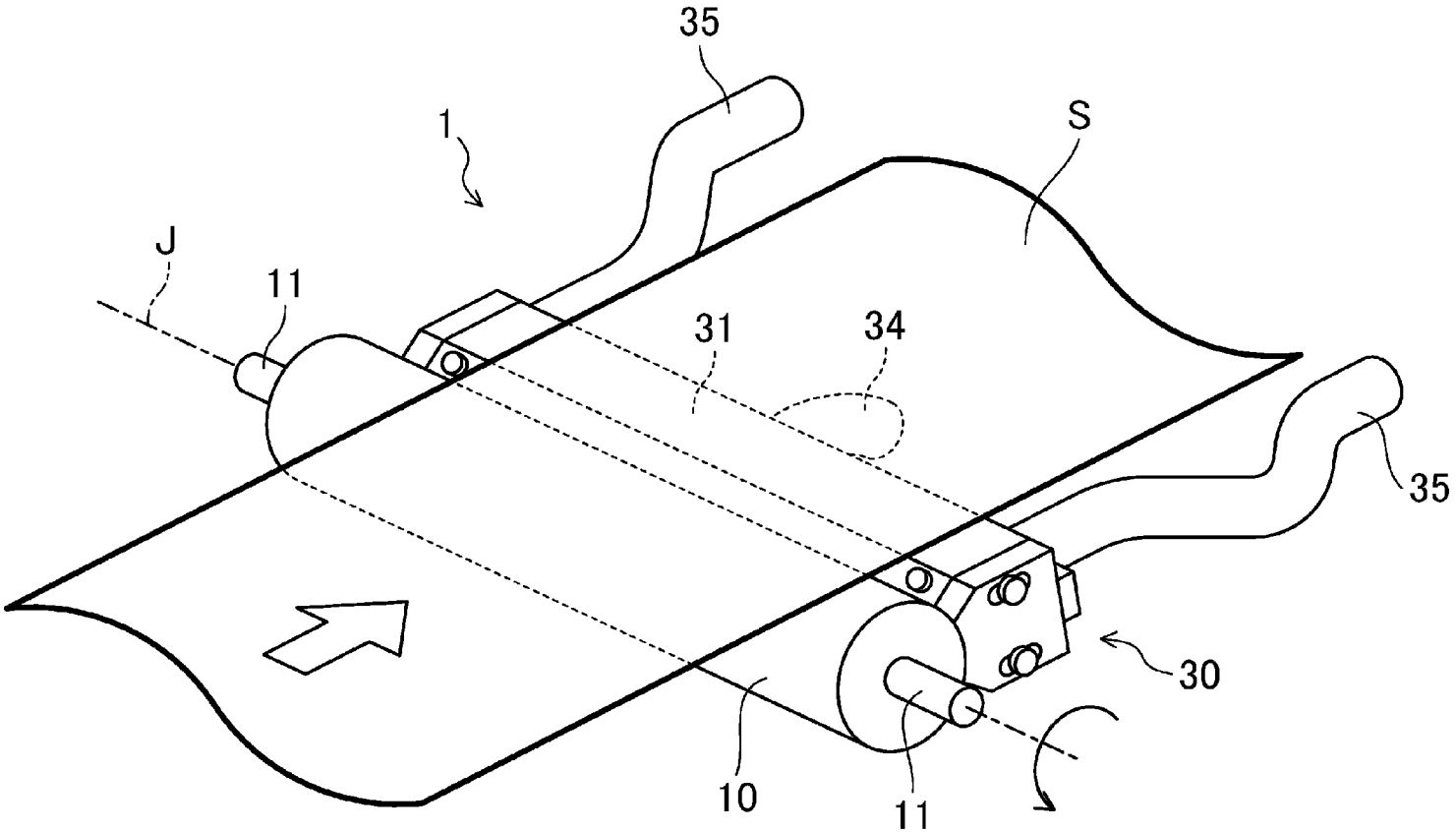
FIG. 1 is a schematic perspective view illustrating a gravure kiss coater according to the present disclosure.
Figure 2:
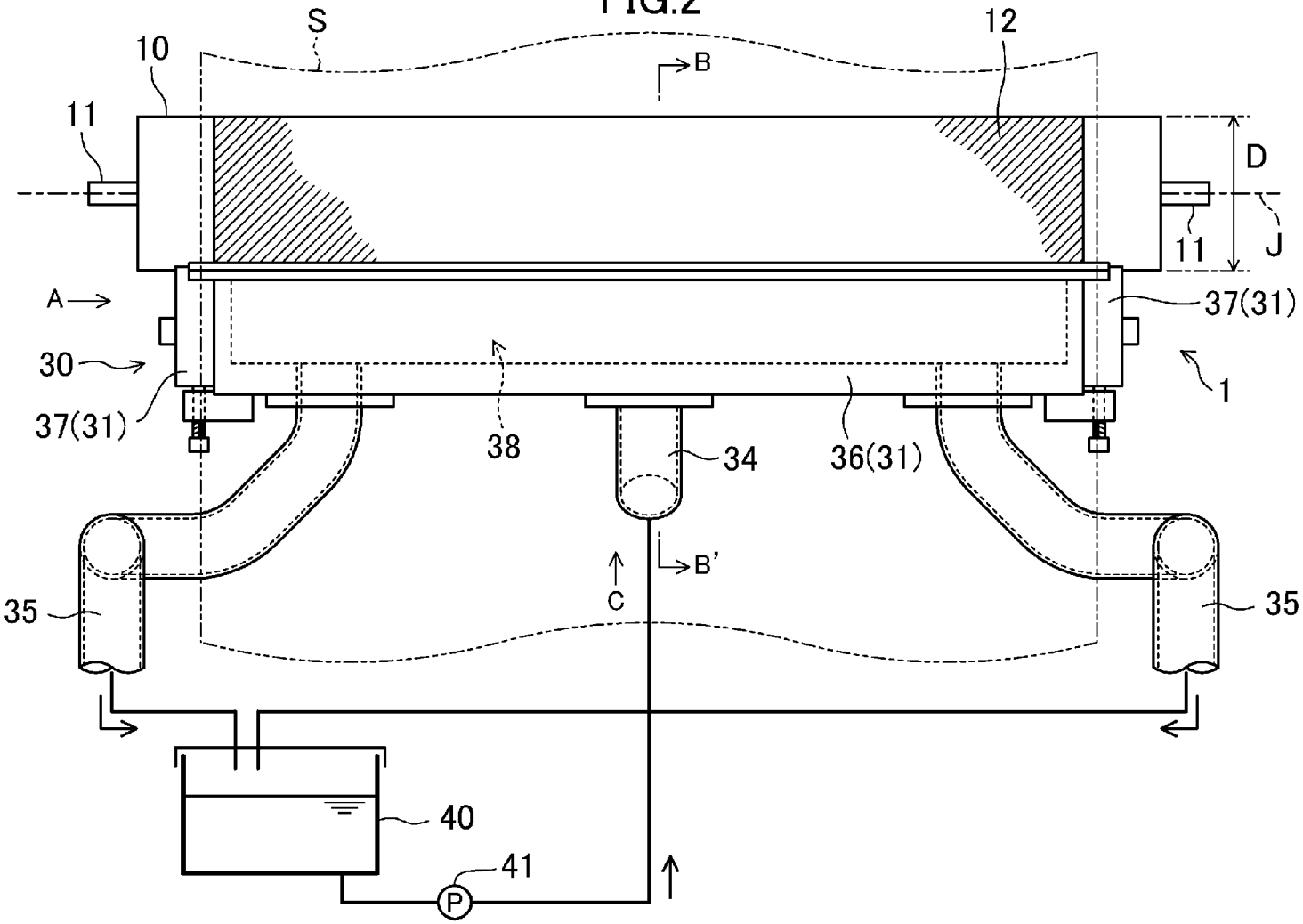
FIG. 2 is a schematic top view of the gravure kiss coater in FIG. 1.

FIGS. 1 and 2 illustrate an example gravure kiss coater 1 to which the present invention is applied (hereinafter simply referred to also as the coater 1). In FIGS. 1 and 2, the character S denotes a target substrate for being coated. The substrate S is made of a pliant sheet-like member of, for example, synthetic resin or metal, and is shaped like a long strip.

Although not shown, typically, the substrate S is unwound from its one end, and the other end of the substrate S is wound while the direction of travel of the substrate S is guided by a guide roller, etc. Thus, the substrate S travels in a certain direction indicated by the hollow arrow in FIG. 1 at high speed. On a coating line, a series of treatments, such as coating and drying, are applied to the traveling substrate S, and FIG. 1 illustrates a region to be coated.

As illustrated in FIG. 1, in the region to be coated, the substrate S travels while being stretched linearly under fixed tension as viewed from side, for example, by winding the substrate S around a pair of guide rollers spaced apart from each other in the direction of travel of the substrate S. The coater 1 contacts, not a substrate S supported by, e.g., an impression cylinder, but the substrate S traveling in a straight line while floating.

The coater 1 includes a small-diameter gravure roll 10, a paint feeder 30, and other components.

Small-Diameter Gravure Roll

The small-diameter gravure roll 10 is a cylindrical member that is longer than the width of the substrate S, and is rotatably supported on an unshown support member through rods 11 at both ends of the small-diameter gravure roll 10. The small-diameter gravure roll 10 is controlled to rotate about a rotation axis J in a predetermined rotation direction at a rotational speed varying with changes in speed of travel of the substrate S.

The small-diameter gravure roll 10 may rotate either in a forward direction or in a reverse direction, and the direction of rotation of the small-diameter gravure roll 10 can be optionally determined depending on use conditions. In the case of the coater 1, the small-diameter gravure roll 10 is determined to rotate in a direction opposite to the direction of travel of the substrate S at a location at which the small-diameter gravure roll 10 contacts the substrate S (a reverse type).

The outside diameter of the small-diameter gravure roll 10 is set within the range from 45 mm to 150 mm. Specifically, when the outside diameter of the small-diameter gravure roll 10 is less than 45 mm, it is dimensionally difficult to horizontally orient the paint feeder 30 in a predetermined manner as described below, and when the outside diameter of the small-diameter gravure roll 10 is greater than 150 mm, the surface of the gravure roll contacts the substrate S at an extremely acute angle. This contact makes it difficult to coat the substrate S with a thin layer of paint, and a properly coated surface cannot be obtained. Additionally, when a paint tending to be easily dried is used, drying of the paint before coating of the substrate S may not be adequately reduced even in a situation where the paint feeder 30 is horizontally oriented in a predetermined manner.

A coating portion 12 is formed on the outer circumferential surface of the small-diameter gravure roll 10. The coating portion 12 includes cells having a predetermined pattern, such as a grid pattern or a diagonal shading pattern. Paint is fed from the paint feeder 30 to the coating portion 12.

Paint Feeder

Figure 3:
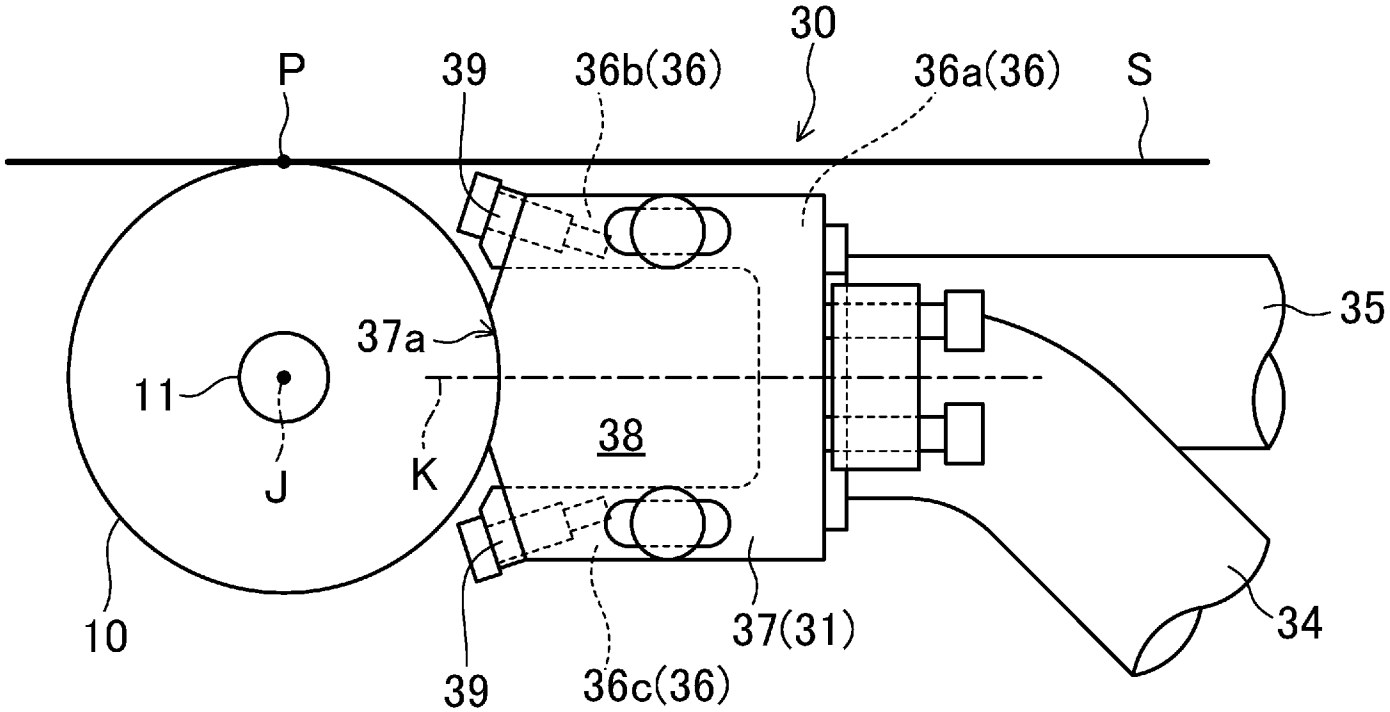
FIG. 3 is a schematic view of the gravure kiss coater when viewed from the direction indicated by the arrow A in FIG. 2.
Figure 4:
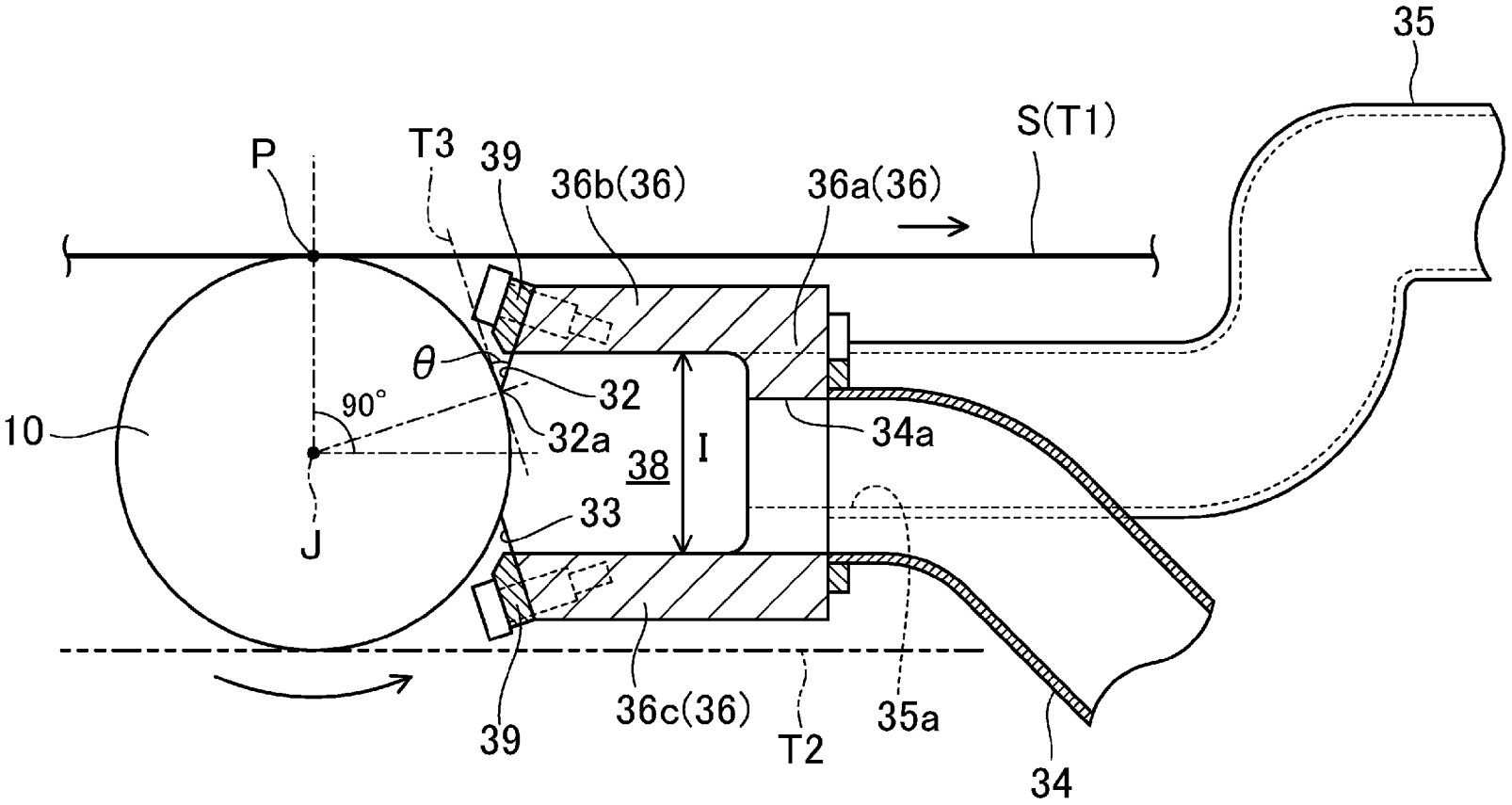
FIG. 4 is a schematic cross-sectional view taken along the line B-B' in FIG. 2.
Figure 5:
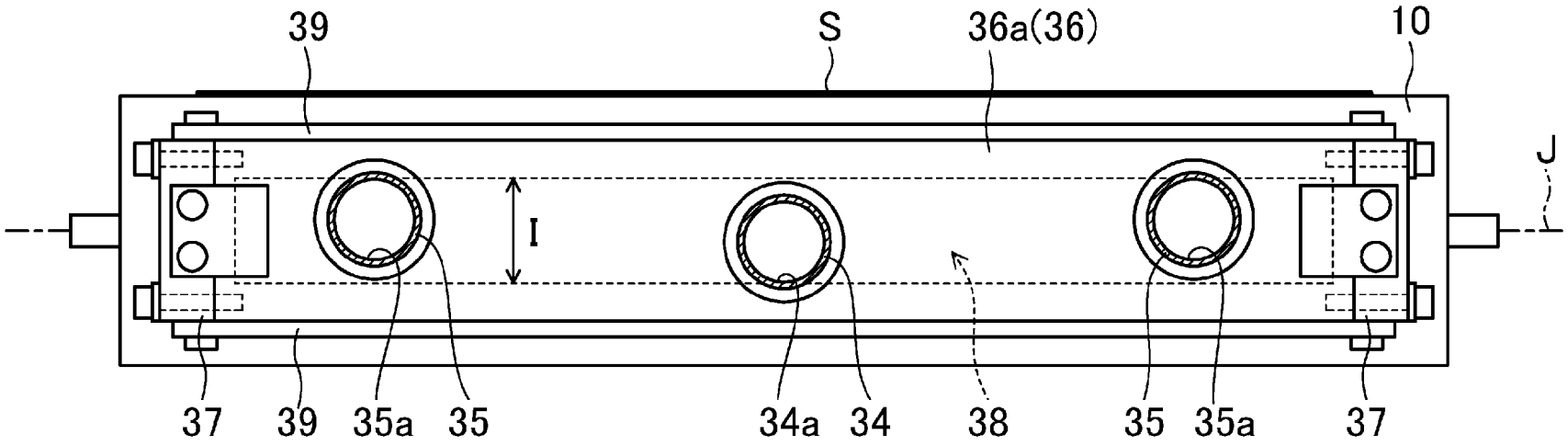
FIG. 5 is a schematic view of the gravure kiss coater when viewed from the direction indicated by the arrow C in FIG. 2.

As illustrated in FIGS. 3-5, the paint feeder 30 includes a case 31 forming its main body, a doctor blade 32, a seal blade 33, a cylindrical liquid feed pipe 34, and cylindrical liquid return pipes 35. The cylindrical liquid feed pipe 34 and cylindrical liquid return pipes 35 form a paint feed path. The outer shape of the main body of the paint feeder 30 is elongated and prismatic, and the main body is adjacent to the small-diameter gravure roll 10, and extends along the small-diameter gravure roll 10.

The case 31 includes an elongated main case 36 having a U-shaped cross section, and side covers 37 placed on both ends of the main case 36. A storage space 38 is formed in the case 31 to store paint.

Specifically, as illustrated in FIGS. 3 and 4, the main case 36 includes a base wall portion 36*a*, a downstream wall portion 36*b*, and an upstream wall portion 36*c*. The base wall portion 36*a* faces the small-diameter gravure roll 10 and has an elongated strip-like shape. The downstream wall portion 36*b* and an upstream wall portion 36*c* protrude from both the longer edges of the base wall portion 36*a* toward the small-diameter gravure roll 10 while facing each other. The downstream wall portion 36*b* and the upstream wall portion 36*c* have the same elongated strip-like shape and the same dimensions.

The side covers 37 are fastened to the corresponding ends of the main case 36, and cover end surfaces of the main case 36. An end portion of each side cover 37 toward the small-diameter gravure roll 10 includes an arcuate seal portion 37*a* that can be in close contact with the outer circumferential surface of the small-diameter gravure roll 10. The side covers 37 can slide on the downstream wall portion 36*b* and the upstream wall portion 36*c*, and are each fixed with the corresponding seal portion 37*a* contacting the outer circumferential surface of the small-diameter gravure roll 10.

The doctor blade 32 is placed on a protruding end of the downstream wall portion 36*b*. The protruding end surface of the downstream wall portion 36*b* is inclined such that an edge of the protruding end surface toward the upstream wall portion 36*c* is relatively closer to the small-diameter gravure roll 10, and the doctor blade 32 is placed along the protruding end surface.

The doctor blade 32 is an elongated blade member having one long side formed with a cutting edge. The other long side of the doctor blade 32 is bolted to the protruding end surface of the downstream wall portion 36*b*, and is pressed with a support bar 39.

Thus, a portion of the doctor blade 32 near a distal end 32*a* thereof, i.e., a portion thereof having the cutting edge, obliquely protrudes from the downstream wall portion 36*b* toward the upstream wall portion 36*c*. The distal end 32*a* of the protruding doctor blade 32 contacts the coating portion 12 formed on the outer circumferential surface of the small-diameter gravure roll 10.

The seal blade 33 is a member similar to the doctor blade 32, and is placed on a protruding end of the upstream wall portion 36*c*. In the coater 1, the seal blade 33 is made of synthetic resin, and the doctor blade 32 is made of metal. As illustrated in FIG. 3, when viewed along the rotation axis J, the downstream wall portion 36*b* and the upstream wall portion 36*c* are symmetric about a reference line K located midway therebetween.

Thus, a portion of the seal blade 33 near a distal end thereof obliquely protrudes from the upstream wall portion 36*c* toward the downstream wall portion 36*b*, and the distal end of the protruding seal blade 33 contacts the coating portion 12 formed on the outer circumferential surface of the small-diameter gravure roll 10.

When viewed along the rotation axis J, the doctor blade 32 and the seal blade 33 are arranged in a generally V shape such that their distal ends are closer to each other than their basal ends. The distal end 32*a* of the doctor blade 32 contacts the coating portion 12 moving toward the location P at which the coating portion 12 contacts the substrate S that has not been coated yet. The distal end of the seal blade 33 contacts the coating portion 12 moving away from the location P at which the coating portion 12 contacts the substrate S that has been coated.

Both ends of the main case 36 are covered with both of the side covers 37 such that the storage space 38 storing paint is formed in the paint feeder 30. Furthermore, since the doctor blade 32, the seal blade 33, and both of the side covers 37 contact the small-diameter gravure roll 10, the storage space 38 is sealed to prevent liquid leakage.

For this reason, the coater 1 can be horizontally oriented such that the small-diameter gravure roll 10 and the paint feeder 30 are arranged in a generally horizontal direction. The horizontal orientation of the coater 1 can ensure adequate space in a direction opposite to the paint feeder 30 with respect to the small-diameter gravure roll 10. This allows the coater 1 to coat the substrate S traveling in a vertical direction or in an oblique direction.

Furthermore, in the case of the coater 1, the configuration of the small-diameter gravure roll 10 and the configuration of the paint feeder 30 are devised to enable the horizontal orientation of the coater 1 even under the substrate S traveling in a generally horizontal direction.

Specifically, as illustrated in FIG. 4, when the horizontally oriented coater 1 is viewed along the rotation axis J, the paint feeder 30 is formed such that the uppermost end of the paint feeder 30 including the downstream wall portion 36*b*, the support bar 39, bolts, and other components are below a tangent line T1 (overlapping the substrate S in FIG. 3) being tangent to the upper end of the small-diameter gravure roll 10.

Furthermore, in the case of the coater 1, the paint feeder 30 is formed such that the lowermost end of the paint feeder 30 is above a tangent line T2 being tangent to the lower end of the small-diameter gravure roll 10. In other words, the uppermost and lowermost ends of the paint feeder 30 are both located between the pair of tangent lines T1 and T2 being respectively tangent to the upper and lower ends of the small-diameter gravure roll 10, and a gap is formed between each tangent line T1, T2 and a corresponding one of the uppermost and lowermost ends of the paint feeder 30.

Thus, in the case of the coater 1, the paint feeder 30 can be horizontally oriented above the substrate S traveling in a generally horizontal direction. In the coater 1 of this embodiment horizontally oriented below the substrate S, the doctor blade 32 and the seal blade 33 are vertically arranged in accordance with the direction of rotation of the small-diameter gravure roll 10.

For example, one end of the liquid feed pipe 34 and one ends of the liquid return pipes 35 are connected to the base wall portion 36*a*. In the case of the coater 1, the number of the liquid feed pipe 34 is one, and the number of the liquid return pipes 35 are two. As illustrated in FIG. 2, the liquid return pipes 35 correspond to both ends of the small-diameter gravure roll 10, and are each placed at a corresponding one of both ends of the storage space 38, and the single liquid feed pipe 34 is placed midway between the liquid return pipes 35.

A portion of the liquid feed pipe 34 near the base wall portion 36*a* extends obliquely downward from the base wall portion 36*a*. A portion of each liquid return pipe 35 near the base wall portion 36*a* extends generally horizontally from the base wall portion 36*a*, is then bent upward once, and extends horizontally at a higher level than that of the storage space 38.

For example, the other end of the liquid feed pipe 34 and the other ends of the liquid return pipes 35 are connected to a storage tank 40 configured to store paint. Paint in the storage tank 40 is fed through the liquid feed pipe 34 to the storage space 38 with a pump 41. The paint in the storage space 38 is returned through the liquid return pipes 35 to the storage tank 40. During operation of the coater 1, paint is fed from the storage tank 40 to the storage space 38 while circulating therebetween through the liquid feed pipe 34 and the liquid return pipes 35.

The interior of the small storage space 38 is kept filled with paint. For this reason, the coating portion 12 facing the interior of the storage space 38 always contacts paint. Thus, paint is stably fed to the coating portion 12 passing through the storage space 38 with the rotation of the small-diameter gravure roll 10.

In this case, the coater 1 is designed to enable stable and accurate coating. Specifically, as illustrated in FIGS. 4 and 5, the inside diameter of each of the liquid feed pipe 34 and the liquid return pipes 35 is set at a value greater than or equal to ½ of the interval I between the inner surfaces of the downstream wall portion 36*b* and the upstream wall portion 36*c* (the width of the storage space 38). The lower end of a connection port 34*a* of the liquid feed pipe 34 is close to the upstream wall portion 36*c* so as to be continuous with the inner surface of the upstream wall portion 36*c*, and the upper end of a connection port 35*a* of each liquid return pipe 35 is close to the downstream wall portion 36*b* in a manner similar to that of the liquid feed pipe 34.

This allows the connection ports 34*a*, 35*a* having a relatively large area to be open to the small storage space 38, and thus allows paint to be efficiently circulated in a situation where the flow rate of paint is reduced. Furthermore, since the lower end of the connection port 34*a* of the liquid feed pipe 34 is close to the upstream wall portion 36*c*, and the upper end of the connection port 35*a* of the liquid return pipe 35 is close to the downstream wall portion 36*b*, this can effectively reduce, for example, stagnation of circulating paint in the storage space 38 and turbulent flow of the circulating paint.

Air is always introduced into the storage space 38 with the rotating small-diameter gravure roll 10. Thus, when the flow of paint in the storage space 38 becomes turbulent, a large amount of air bubbles are generated. When the paint containing air bubbles is deposited on the coating portion 12, the substrate S is unstably coated.

In contrast, in the case of the coater 1, an adequate amount of paint is smoothly and gently fed into the storage space 38 while circulating. This can reduce the generation of air bubbles, and enables the effective removal of air from the interior of the storage space 38. For this reason, the introduction of air bubbles into paint used to coat the substrate S can be effectively reduced, and the substrate S can be stably and accurately coated.

Furthermore, paint flows through a longitudinally central portion of the storage space 38 into the storage space 38, and flows out of both end portions of the storage space 38. This allows paint to smoothly flow in the storage space 38, and can effectively reduce the turbulent flow. Since the total cross-sectional area of the liquid return pipes 35 is greater than the total cross-sectional area of the liquid feed pipe 34, air can be efficiently removed from the storage space 38.

For this reason, even when a small storage space 38 is used for the small-diameter gravure roll 10 rotating at high speed, accurate coating can be stably achieved.

Figure 6:
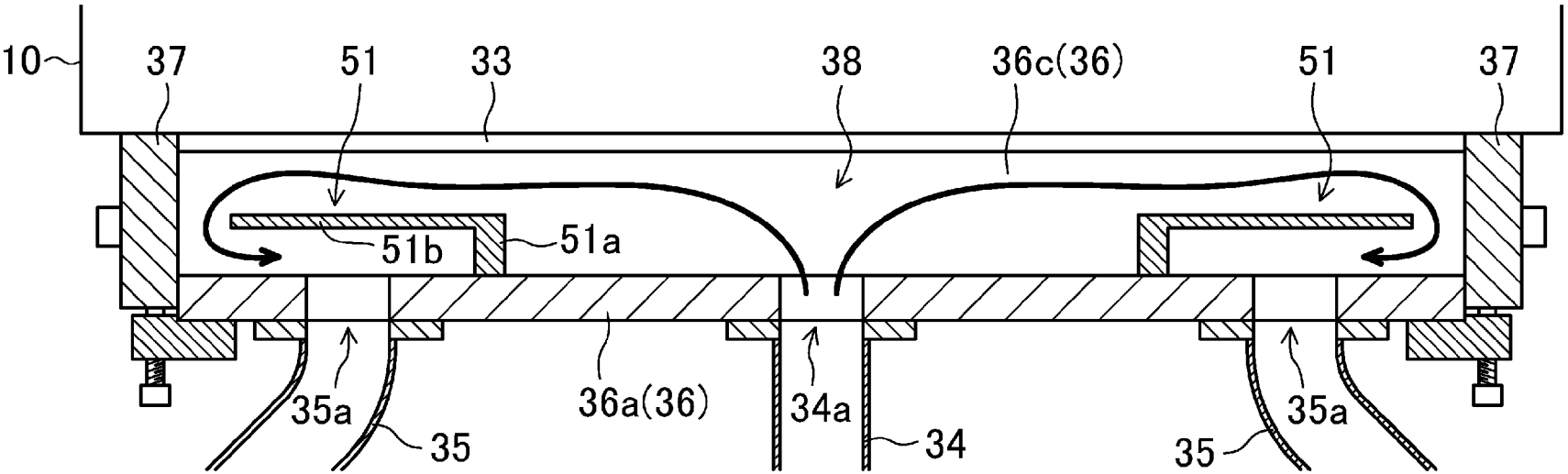
FIG. 6 is a schematic cross-sectional view of a gravure kiss coater according to a variation.

As illustrated in FIG. 6, paint guide walls 51 may be provided in the storage space 38 to guide the circulation of paint.

Specifically, the paint guide walls 51 each having an L-shaped cross section are each provided in a corresponding one of both end portions of the storage space 38. The paint guide walls 51 separate the connection port 34*a* of the liquid feed pipe 34 from the connection port 35*a* of a corresponding one of the liquid return pipes 35. Each paint guide wall 51 includes a base portion 51*a* and a guiding portion 51*b*. The base portion 51*a* protrudes from the inner surface of a portion of the base wall portion 36*a* between the connection port 34*a* of the liquid feed pipe 34 and the connection port 35*a* of a corresponding one of the liquid return pipes 35 toward the small-diameter gravure roll 10 until reaching a central portion of the storage space 38. The guiding portion 51*b* is continuous with a protruding end of the base portion 51*a*, and extends toward a corresponding one of both ends of the storage space 38. One longitudinal end of each of the base portion 51*a* and the guiding portion 51*b* is coupled to the downstream wall portion 36*b*, and the other longitudinal end thereof is coupled to the upstream wall portion 36*c*.

In this case, paint flows into the storage space 38, and then flows toward the small-diameter gravure roll 10. Thereafter, the flow of the paint is separated into right and left paths, and the paint flows toward both end portions of the small-diameter gravure roll 10 along the small-diameter gravure roll 10. Then, the paint is guided to the ends of the small-diameter gravure roll 10 by the paint guide walls 51, and then flows out of the storage space 38. This enables the effective and smooth circulation of paint in the storage space 38.

Placement of Doctor Blade

The distal end 32*a* of the doctor blade 32 contacts the coating portion 12 from a direction opposite to the direction of rotation of the small-diameter gravure roll 10. More specifically, as illustrated in FIG. 4, the doctor blade 32 is located such that when viewed along the rotation axis J, the angle between the doctor blade 32 and a tangent line T3 being tangent to a contact between the distal end 32*a* of the doctor blade 32 and the coating portion 12 forms an acute angle θ from the contact therebetween in the direction of rotation of the small-diameter gravure roll 10.

Placing the doctor blade 32 as above allows thin paint to be accurately deposited on the small-diameter gravure roll 10. Specifically, the doctor blade 32 functions to scrape redundant paint deposited on the coating portion 12, and its cutting edge contacts the coating portion 12 in a direction opposite to the direction of rotation of the small-diameter gravure roll 10, thereby smoothly scraping redundant paint from the entire area of the coating portion 12.

This reduces variations in amount of paint deposited, and even when the amount of paint deposited is small, paint can be stably deposited on the coating portion 12.

In addition, in the case of the coater 1, as described above, the paint feeder 30 can be horizontally oriented under the substrate S traveling in a generally horizontal direction. This allows the location P at which the small-diameter gravure roll 10 and the substrate S contact each other (the location at which the substrate S is coated) to be within the range of rotation angles equal to or less than 90° from the distal end 32*a* of the doctor blade 32.

For this reason, the substrate S is coated with thin paint, which is deposited on the coating portion 12 after being scraped with the doctor blade 32, in an extremely short time. Thus, even when the substrate S is coated with a thin paint tending to be easily dried, the substrate S can be stably coated without impairment of the coating performance.

Other Embodiments

The gravure kiss coater 1 according to the present disclosure is not limited to the above-mentioned embodiment, and include various other configurations.

Figure 7:
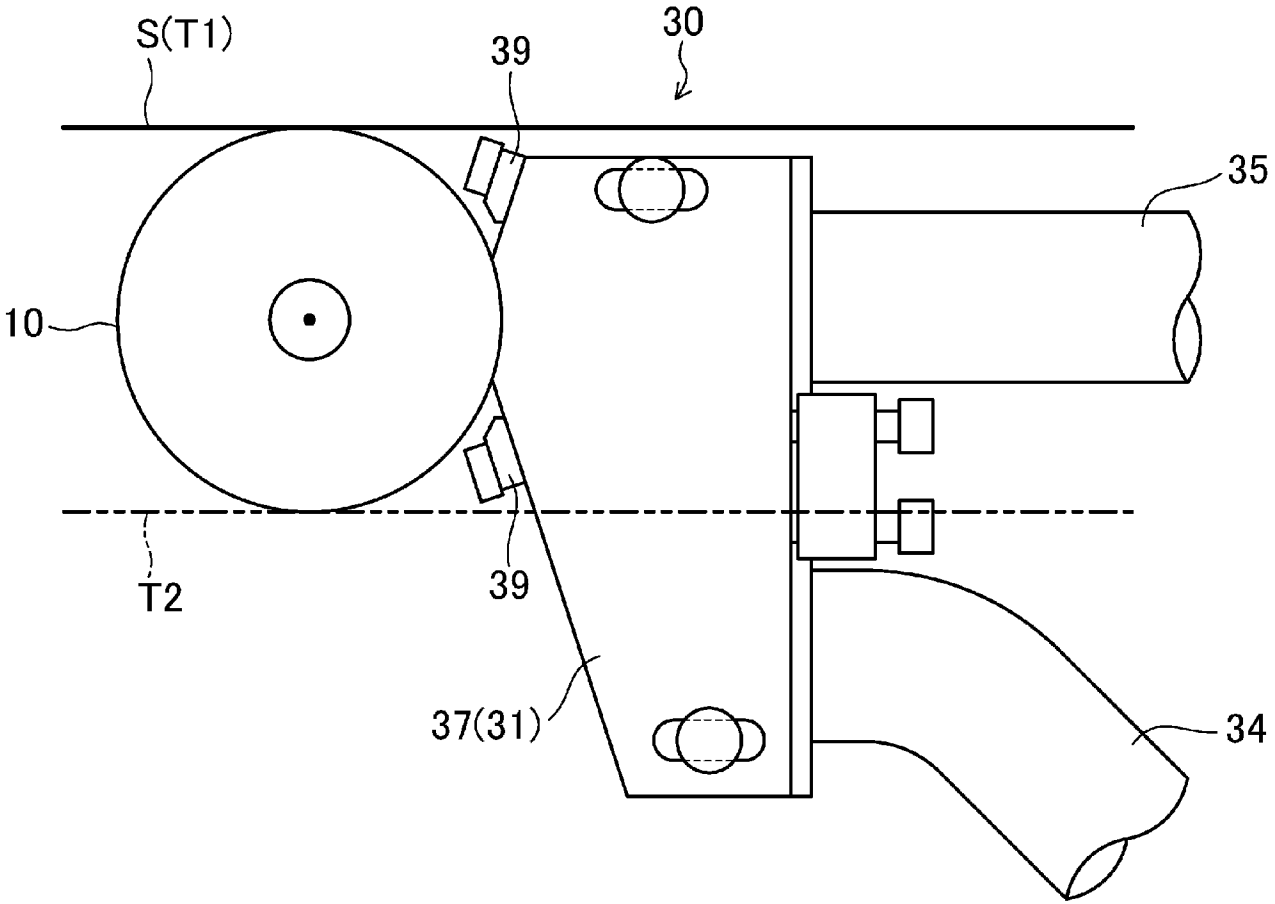
FIG. 7 is a schematic view of a gravure kiss coater according to another variation.

As illustrated in FIG. 7, only any one of the uppermost and lowermost ends of the paint feeder 30 may be located between the pair of tangent lines T1 and T2 being each tangent to a corresponding one of the upper and lower ends of the small-diameter gravure roll 10. Also in this case, a paint tending to be easily dried can be used, and the substrate S traveling in either of various directions can be coated with the paint feeder 30 horizontally oriented in a predetermined manner.

The storage space 38 does not always need to be sealed, and may be open. Note that in this case, the paint feeder 30 cannot be horizontally oriented, and for this reason, the paint feeder 30 needs to be vertically oriented so as to be located below the small-diameter gravure roll 10. For example, the location and angle at which the seal blade 33 is placed can change depending on specifications.

DESCRIPTION OF REFERENCE CHARACTERS

1 GRAVURE KISS COATER
10 SMALL-DIAMETER GRAVURE ROLL
12 COATING PORTION
30 PAINT FEEDER
31 CASE
32 DOCTOR BLADE
32*a* DISTAL END
33 SEAL BLADE
34 LIQUID FEED PIPE
35 LIQUID RETURN PIPE
36*b* DOWNSTREAM WALL PORTION
36*c* UPSTREAM WALL PORTION
37 SIDE COVER
38 STORAGE SPACE
D OUTSIDE DIAMETER
J ROTATION AXIS
S BASE MATERIAL

The invention claimed is:

1. A gravure kiss coater comprising:

a cylindrical small-diameter gravure roll having an outside diameter in a range of 45-150 mm, and having an outer circumferential surface including a coating portion; and a paint feeder extending along the small-diameter gravure roll and feeding paint to the coating portion, wherein while rotation of the small-diameter gravure roll is controlled, a sheet-like substrate is coated with paint by pressing the coating portion against the substrate traveling while being stretched linearly, the paint feeder includes a doctor blade extending along the small-diameter gravure roll and having a distal end contacting the coating portion moving toward a location at which the coating portion contacts the substrate, a seal blade extending along the small-diameter gravure roll and having a distal end contacting the coating portion moving away from the location at which the coating portion contacts the substrate, a case supporting the doctor blade and the seal blade and forming a storage space that stores paint, the storage space being sealed with side covers such that the paint feeder is capable of being horizontally oriented to allow vertical arrangement of the doctor blade and the seal blade, and a paint feed path through which paint is fed to the storage space, the distal end of the doctor blade is located so as to contact the coating portion from a direction opposite to a direction of rotation of the small-diameter gravure roll, the small-diameter gravure roll is capable of contacting the substrate within a range of rotation angles equal to or less than 90° from the distal end of the doctor blade, when the paint feeder is horizontally oriented, at least any one of uppermost and lowermost ends of the paint feeder is located between a pair of tangent lines being each tangent to a corresponding one of upper and lower ends of the small-diameter gravure roll when viewed along a rotation axis of the small-diameter gravure roll, the case includes a downstream wall portion being continuous with the doctor blade and defining the storage space, and an upstream wall portion facing the downstream wall portion, being continuous with the seal blade, and defining the storage space, the paint feed path includes a liquid feed pipe which has a connection port having one end close to the upstream wall portion, and through which paint is fed to the storage space, and at least one liquid return pipe which has a connection port having one end close to the downstream wall portion, and through which paint is returned from the storage space, and an inside diameter of each of the liquid feed pipe and the at least one liquid return pipe is set at a value greater than or equal to ½ of a distance between the downstream wall portion and the upstream wall portion, the paint passes through a portion of the paint feed path at a higher level than that of the storage space, and returns to a storage tank, and at least one paint guide wall having an L-shaped cross section is provided in the storage space to separate the connection port of the liquid feed pipe from the connection port of the at least one liquid return pipe.

2. The gravure kiss coater of claim 1, wherein the at least one liquid return pipe includes two liquid return pipes, the two liquid return pipes are placed at locations corresponding to both end portions of the small-diameter gravure roll, and the single liquid feed pipe is placed midway between the two liquid return pipes.

* * * * *